US010126064B2

(12) United States Patent
Takeuchi et al.

(10) Patent No.: US 10,126,064 B2
(45) Date of Patent: Nov. 13, 2018

(54) HEAT EXCHANGER

(71) Applicant: DENSO CORPORATION, Kariya, Aichi-pref. (JP)

(72) Inventors: Kazuhiro Takeuchi, Kariya (JP); Yoshitake Hoshino, Kariya (JP); Nobuyuki Uozumi, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 15/743,623

(22) PCT Filed: Jul. 7, 2016

(86) PCT No.: PCT/JP2016/070133

§ 371 (c)(1),
(2) Date: Jan. 10, 2018

(87) PCT Pub. No.: WO2017/026210

PCT Pub. Date: Feb. 16, 2017

(65) Prior Publication Data

US 2018/0202720 A1 Jul. 19, 2018

(30) Foreign Application Priority Data

Aug. 7, 2015 (JP) ..... 2015-157383

(51) Int. Cl.
*F28F 9/02* (2006.01)
*F28D 1/053* (2006.01)
*F28F 9/26* (2006.01)

(52) U.S. Cl.
CPC ..... *F28D 1/053* (2013.01); *F28F 9/02* (2013.01); *F28F 9/26* (2013.01); *F28F 2230/00* (2013.01)

(58) Field of Classification Search
CPC ..... F28D 1/05358; F28F 9/0226; F28F 9/02; F28F 17/005; F28F 19/006; F28F 2230/00; F28F 2275/08; F28F 2275/085
(Continued)

(56) References Cited

U.S. PATENT DOCUMENTS 4,544,029 A * 10/1985 Cadars ..... F28F 9/0226 165/149
4,649,628 A * 3/1987 Allemandou ..... F28F 9/0226 165/148

(Continued)

FOREIGN PATENT DOCUMENTS

JP S55034109 U 3/1980
JP 2008528930 A 7/2008
JP 2015127631 A 7/2015

*Primary Examiner* — Frantz Jules
*Assistant Examiner* — Jose O Class-Quinones
(74) *Attorney, Agent, or Firm* — Harness, Dickey & Pierce, P.L.C.

(57) ABSTRACT

A core plate of a header tank of a heat exchanger has an annular housing groove portion housing a tip part of a tank body and a seal component. The seal component is housed in a housing space formed by the housing groove portion and the tip part of the tank body. The housing groove portion has a bottom wall part which supports the seal component together with the tip part of the tank body, and an outer wall part located at an outer periphery side of the bottom wall part. The outer wall part has at least one discharge part through which liquid is discharged to outside from a clearance between a side surface of the tank body opposing the outer wall part and a lower side of the outer wall part in a stacking direction of tubes.

3 Claims, 6 Drawing Sheets

(58) Field of Classification Search
USPC ..... 165/70, 76, 134.1
See application file for complete search history.

(56) References Cited

U.S. PATENT DOCUMENTS

| | | | | |
|---|---|---|---|---|
| 5,195,581 | A * | 3/1993 | Puntambekar | F28F 9/0226 156/91 |
| 5,899,267 | A * | 5/1999 | Kroetsch | F28F 9/0226 165/173 |
| 7,156,401 | B2 * | 1/2007 | Merklein | F28F 9/0226 165/149 |
| 2008/0121386 | A1 * | 5/2008 | Hakamata | B21D 53/02 165/173 |
| 2008/0135220 | A1 | 6/2008 | Aksoy et al. | |
| 2017/0038163 | A1 | 2/2017 | Hakamata et al. | |

* cited by examiner

HEAT EXCHANGER

CROSS REFERENCE TO RELATED APPLICATIONS

This application is a U.S. National Phase Application under 35 U.S.C. 371 of International Application No. PCT/JP2016/070133 filed on Jul. 7, 2016 and published in Japanese as WO 20171026210 A1 on Feb. 16, 2017. This application is based on and claims the benefit of priority from Japanese Patent Application No. 2015-157383 filed on Aug. 7, 2015. The entire disclosures of all of the above applications are incorporated herein by reference.

TECHNICAL FIELD

The present disclosure relates to a heat exchanger such as radiator which cools the cooling water of an internal-combustion engine.

BACKGROUND ART

Conventionally, a heat exchanger includes a core part in which tubes and corrugated fins are alternately stacked with each other, and a header tank joined to the end of the tube in the longitudinal direction to communicate with the tube. The header tank has a core plate to which the tube is inserted and joined, and a tank body which forms the interior space of the header tank with the core plate. The side end of the tank body is fixed to the core plate. The core plate includes a tube junction portion with a flat surface on the inner side of the header tank and a tube insertion hole in which the tube is inserted, and a groove portion defined on the outer side of the tube junction portion to accept the side end of the tank body.

In this kind of heat exchanger, it is known that a seal component (for example, seal ring) is arranged in the groove portion of a core plate, and that the seal component is supported between the bottom of the groove portion and the side end of the tank body (for example, refer to Patent Literature 1), so as to secure the sealing property inside of the header tank.

PRIOR ART LITERATURES

Patent Literature

Patent Literature 1: JP 2008-528930 A

SUMMARY OF INVENTION

Meanwhile, the inventors study whether fluid leaks out of a header tank in a heat exchanger in which a seal component is supported between the bottom of the groove portion of the core plate and the side end of the tank body. As a result, it is found out that leakage of fluid might arise in the header tank.

When the inventors investigated about the heat exchanger in which the leakage is generated, it is found out that the bottom of the groove portion of the core plate is corroded in the heat exchanger. The corrosion causes a minute gap between the seal component and the bottom of the groove portion of the core plate. As a result, the fluid leaks out of the header tank.

The inventors examine in detail factors causing the corrosion in the bottom of the groove portion of the core plate to solve an issue that the fluid leaks out of the header tank.

As a result, it is found that corrosive liquid which exists outside of the heat exchanger invades through the clearance between the groove portion of the core plate and the side end of the header tank, and stagnates on the bottom of the groove portion of the core plate.

It is an object of the present disclosure to provide a heat exchanger in which leak of fluid from a header tank can be restricted by suppressing corrosion of a core plate caused by corrosive liquid which exists outside.

According to an aspect of the present disclosure, a heat exchanger includes:

- a core part having a plurality of tubes stacked up and down, a fluid flowing through the plurality of tubes; and
- a header tank arranged at ends of the tubes in the longitudinal direction, the header tank extending in a stacking direction of the tubes and communicating with the plurality of tubes.

The header tank has

- a core plate to which the plurality of tubes is joined in a state where the ends of the tubes in the longitudinal direction are inserted in a plurality of tube insertion holes,
- a tank body fixed to the core plate to form a tank interior space together with the core plate to communicate with the plurality of tubes, and
- a seal component interposed between the tank body and the core plate to suppress a leak of the fluid out of the tank interior space.

The core plate has

- a tube junction portion having the plurality of tube insertion holes, and
- a housing groove portion having an annular shape surrounding an outer side of the tube junction portion and housing a tip part of the tank body and the seal component.

The seal component is housed in a housing space formed by an inner periphery surface of the housing groove portion and an opposing surface of the tip part of the tank body opposing the core plate, and

- the housing groove portion has a bottom wall part which supports the seal component together with the tip part of the tank body, and an outer wall part located at the outer periphery side of the bottom wall part.

The outer wall part has at least one discharge part which discharges liquid from a clearance formed between a side surface of the tank body opposing the outer wall part, and a lower side of the outer wall part in the stacking direction of the tubes.

Thus, the seal component is supported between the bottom wall part of the housing groove portion of the core plate and the surface of the tip part of the tank body, such that the tank interior space can be sealed in the header tank.

Furthermore, in the heat exchanger of the present disclosure, at least one discharge part is provided in the outer wall part of the core plate at the lower side in the stacking direction of the tubes. Accordingly, if corrosive liquid flows in the clearance between the tank body and the core plate, the liquid can be discharged outside through the discharge part of the outer wall part. As a result, the corrosive liquid invaded from the outside of the heat exchanger can be restricted from staying at the bottom wall part of the housing groove portion of the core plate.

Therefore, the corrosion of the core plate caused by the corrosive liquid which exists outside is suppressed, and it becomes possible to restrict the leak of fluid from the header tank.

DESCRIPTION OF EMBODIMENTS

Figure 1:
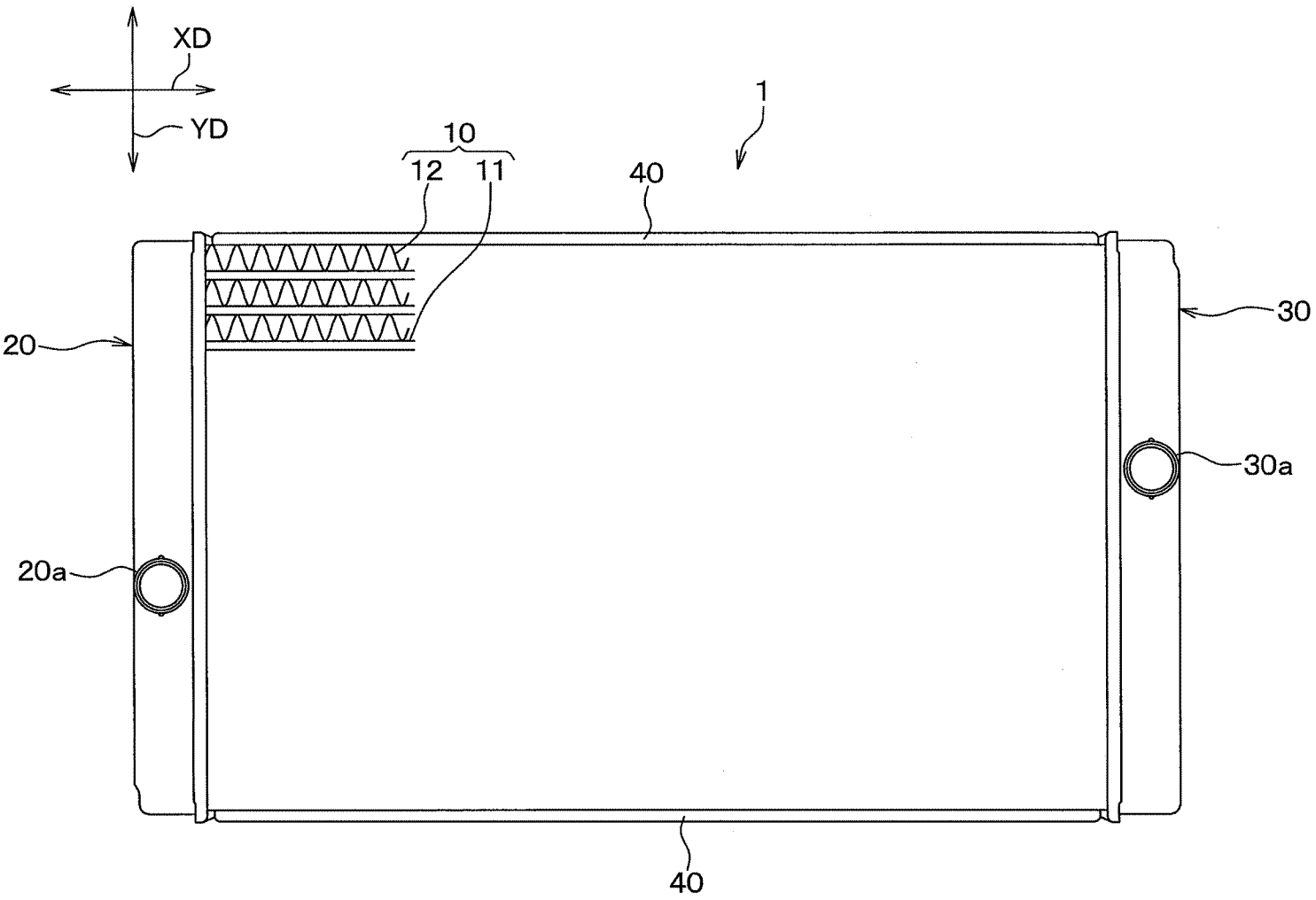
FIG. 1 is a schematic front view of a radiator according to an embodiment.

Hereinafter, embodiments will be described according to the drawings. Same or equivalent portions among respective embodiments below are labeled with same reference numerals in the drawings, and redundant explanation for the part may be omitted.

When only a part of a configuration is described in an embodiment, another preceding embodiment may be applied to the other parts of the configuration.

Embodiment

An embodiment of the present disclosure is described with reference to FIG. 1-FIG. 8. In this embodiment, a heat exchanger according to the present disclosure is applied to a radiator mounted to a vehicle to cool a fluid (for example, cooling water) to be cooled, by heat exchange with air outside of the vehicle (namely, outside air). Specifically, in this embodiment, the heat exchanger of the present disclosure is applied to a radiator 1 located at a front side space of the vehicle to cool the cooling water of the internal-combustion engine, which is not illustrated, by heat exchange with the outside air.

First, the basic configuration of the radiator 1 of this embodiment is explained with reference to FIG. 1. As shown in FIG. 1, the radiator 1 of this embodiment is configured by a down-flow type heat exchanger in which cooling water flows along a horizontal direction. The radiator 1 has a core part 10 that is a heat emitting part in which heat is exchanged between the cooling water of the internal-combustion engine and the outside air. The core part 10 includes the tubes 11 and the fins 12 alternately arranged in the up-and-down direction. Hereafter, in this embodiment, the stacking direction of the tubes 11 and the fins 12 is called as a tube stacking direction YD. The tube stacking direction YD is a direction extending along the up-and-down direction.

The cooling water of the internal-combustion engine flows inside a channel, which is not illustrated, formed in each of the tubes 11. Each of the tubes 11 of this embodiment extends such that the longitudinal direction corresponds to the horizontal direction, and has a flat form so that the major direction in the cross-section extends along the flowing direction of the outside air.

The flat form includes an ellipse shape defined by a curved line combining an arc part with a large curvature radius and an arc part with a small curvature radius, and an oblong shape combining an arc part and a straight part. In this embodiment, for easy explanation, the longitudinal direction of the tube 11 is called as a tube longitudinal direction XD, and a direction perpendicular to the tube longitudinal direction XD and the tube stacking direction YD is called as a tube width direction ZD. The tube width direction ZD is a direction matching the major direction in the cross-section of the tube 11.

The fin 12 is a component which increases a heat transfer area with the outside air, and facilitates the heat exchange between the outside air and the cooling water. The fin 12 of this embodiment is fabricated in the corrugated shape, and is joined to the flat surfaces of the tubes 11 on the both sides.

Each of the tubes 11 and the fins 12 of this embodiment is made of metal excellent in thermal conductivity, corrosion resistance, etc. (for example, aluminium alloy). The radiator 1 of this embodiment is formed by integrally brazing the tube 11, the fin 12, a core plate 21 to be mentioned later, and a side plate 40 to be mentioned later with a brazing material covering a predetermined part of the components.

A pair of header tanks 20 and 30, in which a space is formed, are arranged at the both ends of each tube 11 in the tube longitudinal direction XD, and extends in the tube stacking direction YD. Each of the header tanks 20 and 30 is joined to the core plate 21 in the state where the end of each tube 11 in the tube longitudinal direction XD is inserted in a tube insertion hole 211*a* of the core plate 21 to be mentioned later. The internal passage in each tube 11 is communicated with the tank interior space 20*b* formed inside each of the header tanks 20 and 30.

One header tank, of the pair of header tanks 20 and 30, configures an entrance side tank 20 which distributes and supplies high-temperature cooling water flowing out of the internal-combustion engine which is not illustrated to each tube 11. The entrance side tank 20 has an inflow port pipe 20*a* connected to the exit side of the cooling water of the internal-combustion engine through a hose which is not illustrated.

The other header tank, of the pair of header tanks 20 and 30, configures an exit side tank 30 which collects the cooling water cooled in the core part 10 by heat exchange with the outside air to discharge. The exit side tank 30 has an outlet port pipe 30*a* connected to the entrance side of the cooling water of the internal-combustion engine through a hose which is not illustrated.

The side plate 40 is disposed at both ends of the core part 10 in the tube stacking direction YD to reinforce the core part 10. The side plate 40 extends along the tube longitudinal direction XD, and the both ends are connected to the respective header tanks 20 and 30. The side plate 40 of this embodiment is made of metal such as an aluminium alloy.

Figure 2:
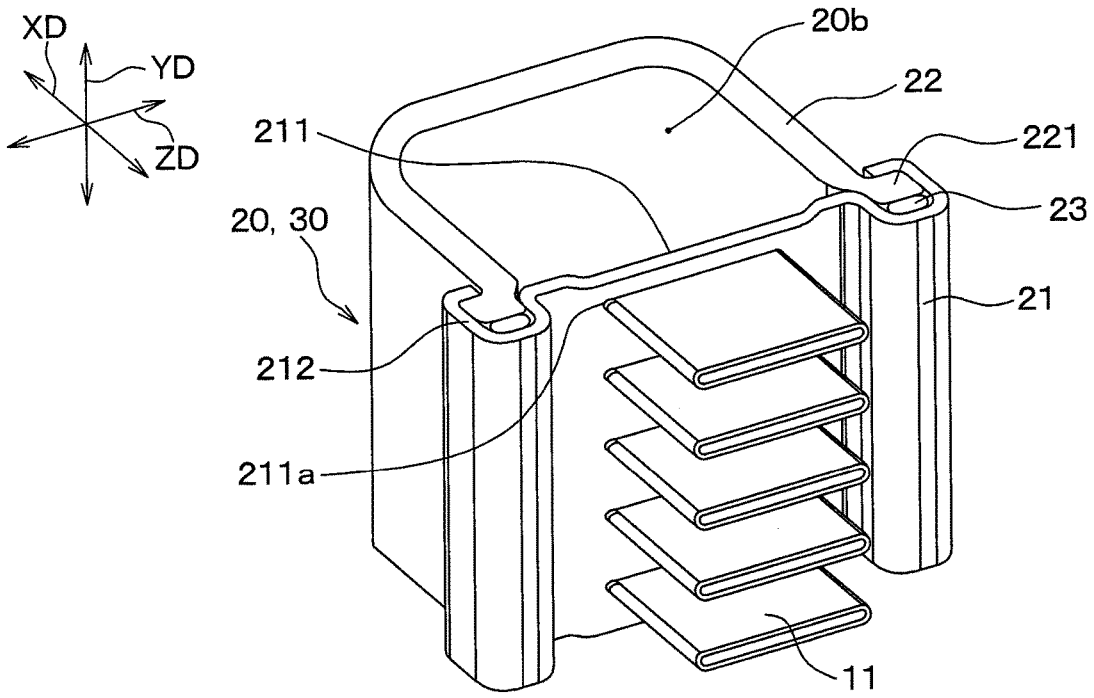
FIG. 2 is a perspective view illustrating a cross-section of a header tank of the radiator of the embodiment.

Detailed structure of each header tank 20, 30 is explained with reference to FIG. 2-FIG. 6. As shown in FIG. 2, each of the header tanks 20 and 30 has the core plate 21 joined with the inserted tubes 11, a tank body 22 which forms the tank interior space 20*b* of each header tank 20, 30 with the core plate 21, and a seal component 23.

In this embodiment, the tank body 22 is fixed to the core plate 21 in the state where the seal component 23 is interposed between the core plate 21 and the tank body 22, by plastically deforming a projection piece 213 of the core plate 21, to be mentioned later, to be forced on the tank body 22.

Figure 3:
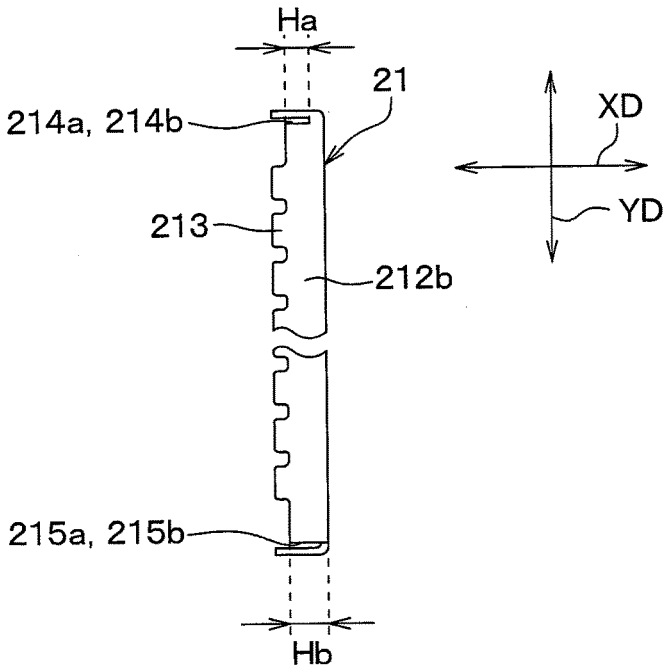
FIG. 3 is a front view illustrating a core plate alone, of the radiator of the embodiment.
Figure 4:
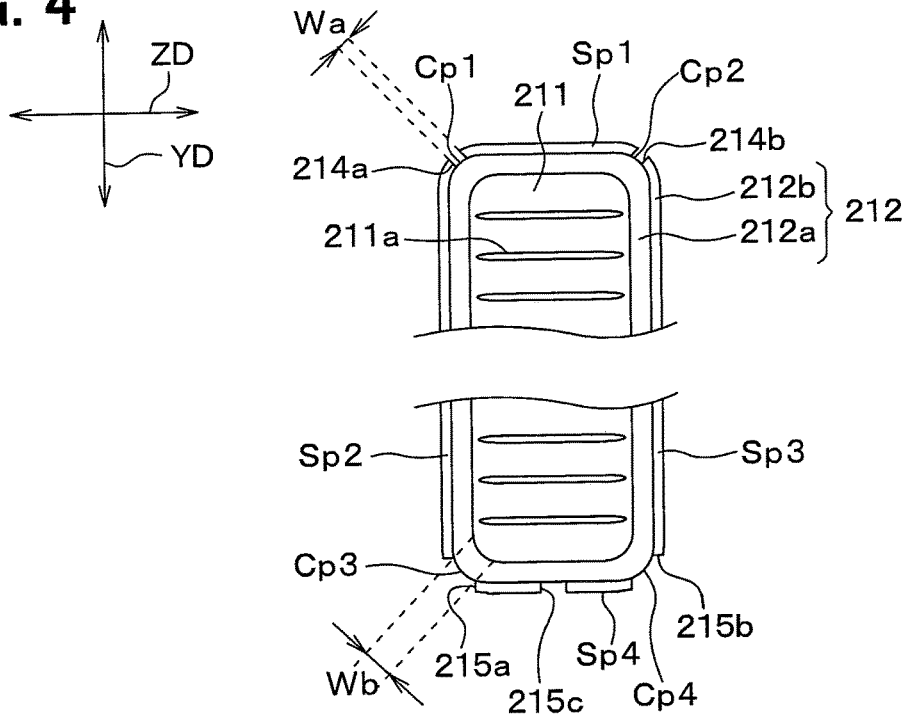
FIG. 4 is a bottom view of the core plate alone, of the radiator of the embodiment.

The core plate 21 of this embodiment is made of metal excellent in thermal conductivity, corrosion resistance, etc. (for example, aluminium alloy). As shown in FIG. 3 and FIG. 4, the core plate 21 has a tube junction portion 211 to which the tubes 11 are joined, and an annular housing groove portion 212 surrounding the outer side of the tube junction portion 211. The housing groove portion 212 houses the seal component 23*a* and a flange part 221 of the tank body 22 to be mentioned later.

Figure 5:
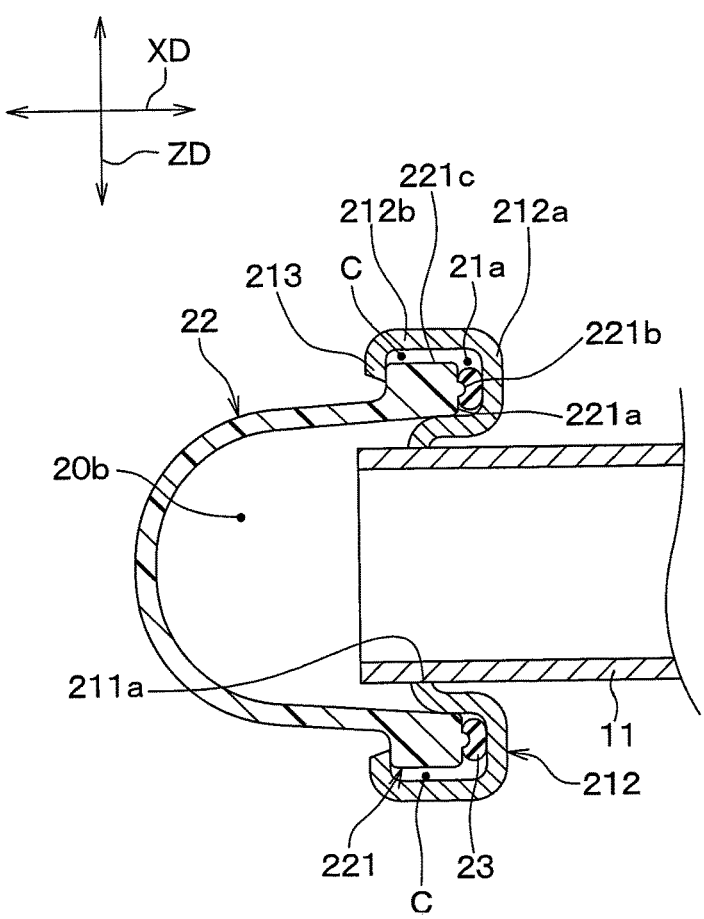
FIG. 5 is a sectional view, taken along a tube longitudinal direction, illustrating the header tank of the radiator of the embodiment.
Figure 6:
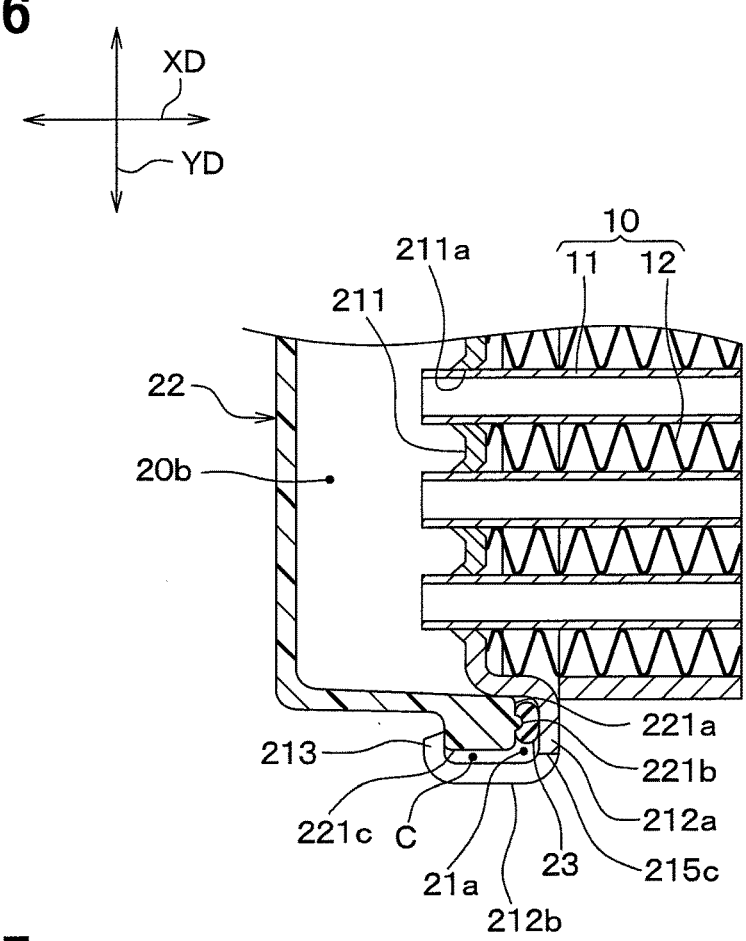
FIG. 6 is a sectional view, taken along a tube stacking direction, illustrating the header tank of the radiator of the embodiment.

As shown in FIG. 4 and FIG. 5, the housing groove portion 212 has three wall surfaces to define a U-shape. That is, when seen from the tube stacking direction YD, the housing groove portion 212 has a bottom wall part 212*a* extending in the tube width direction ZD, an outer wall part 212*b* bent in L-shape from the bottom wall part 212*a* to extend in the tube longitudinal direction XD, and an inner wall part 212*c* bent in L-shape from the bottom wall part 212*a* to extend in the tube longitudinal direction XD.

A housing space 21*a* housing the seal component 23 is formed between each of the wall parts 212*a*-212*c* and an opposing surface of the flange part 221 of the tank body 22 opposing the core plate 21 to be mentioned later.

The outer wall part 212*b* is a wall part positioned at the outer periphery side of the bottom wall part 212*a*. The inner wall part 212*c* is a wall part positioned at the inner periphery side of the bottom wall part 212*a*. As shown in FIG. 3, plural projection pieces 213 for fitting are formed at the end of the outer wall part 212*b* of the housing groove portion 212.

The outer wall part 212*b* of this embodiment has cutout grooves 214*a* and 214*b* shaped in a slit, at the upper side in the tube stacking direction YD (namely, the up-and-down direction). Each of the cutout grooves 214*a* and 214*b* is formed to suppress stress concentration generated on the core plate 21 when the tank body 22 is fixed to the core plate 21 by being plastically deformed. That is, the cutout grooves 214*a* and 214*b* are formed to easily fabricate the core plate 21.

Moreover, the outer wall part 212*b* of this embodiment has plural discharge parts 215*a*-215*c* at the lower side in the tube stacking direction YD to discharge liquid from a clearance C formed between a side surface 221*c* of the tank body 22 and the outer wall part 212*b*.

As shown in FIG. 4, specifically, the core plate 21 of this embodiment is configured to have rectangle-like form when seen from the tube longitudinal direction XD. That is, the core plate 21 of this embodiment is formed to have four sides Sp1-Sp4 and four corner parts Cp1-Cp4 when seen from the tube stacking direction YD.

The outer wall part 212*b* of this embodiment has the pair of cutout grooves 214*a* and 214*b* at positions corresponding to the pair of corner parts Cp1 and Cp2 at the upper side, of the positions corresponding to the four corner parts Cp1-Cp4 of the core plate 21.

Moreover, the outer wall part 212*b* of this embodiment has a pair of discharge parts 215*a* and 215*b* at positions corresponding to the pair of corner parts Cp3 and Cp4 at the lower side, of the positions corresponding to the four corner parts Cp1-Cp4 of the core plate 21.

Furthermore, the outer wall part 212*b* of this embodiment has the discharge part 215*c* at the position corresponding to the lower side Sp4, of the positions corresponding to the four sides Sp1-Sp4 of the core plate 21. Hereafter, for convenience in the explanation, of the discharge parts 215*a*-215*c*, the discharge part corresponding to the corner part Cp3 is defined as a first discharge part 215*a*, the discharge part corresponding to the corner part Cp4 is defined as a second discharge part 215*b*, and the discharge part corresponding to the side Sp4 is defined as a third discharge part 215*c*.

As mentioned above, each of the discharge parts 215*a*-215*c* is formed to drain liquid, and differs from the cutout groove 214*a*, 214*b* greatly in respect of the function, as the cutout groove 214*a*, 214*b* is formed for easy fabrication of the core plate 21.

Each of the discharge parts 215*a*-215*c* of this embodiment differs from the cutout groove 214*a*, 214*b* also in respect of the structure. That is, in consideration of the drain nature for discharging liquid, the opening area of each of the discharge parts 215*a*-215*c* is larger than the opening area of each of the cutout grooves 214*a*, 214*b*.

Specifically, as shown in FIG. 3, the opening depth Hb of each of the discharge parts 215*a*-215*c* of this embodiment in the tube longitudinal direction XD is larger than the opening depth Ha of each of the cutout grooves 214*a* and 214*b* in the tube longitudinal direction XD.

More specifically, the opening depth Ha of each of the cutout grooves 214*a* and 214*b* is set up so that the outer wall part 212*b* and the seal component 23 to be mentioned later overlap in the tube stacking direction YD. That is, the opening depth Ha of each of the cutout grooves 214*a* and 214*b* is set up so that the seal component 23 to be mentioned later is not exposed outside from the housing groove portion 212.

In contrast, the opening depth Hb of each of the discharge parts 215*a*-215*c* of this embodiment is set up so that the outer wall part 212*b* and the seal components 23 to be mentioned later do not overlap in the tube stacking direction YD. That is, the opening depth Hb of each of the discharge parts 215*a*-215*c* is set up so that the seal component 23 to be mentioned later is exposed outside from the housing groove portion 212.

Moreover, as shown in FIG. 4, the opening width Wb of each of the discharge parts 215*a*-215*c* of this embodiment is larger than the opening width Wa of each of the cutout grooves 214*a* and 214*b* in the tube longitudinal direction XD.

More specifically, the opening width Wa of each of the cutout grooves 214*a* and 214*b* is set within a range between 1 mm and 2 mm to improve the fabrication nature of the core plate 21.

In contrast, the opening width Wb of each of the discharge parts 215*a*-215*c* of this embodiment is set within a range between 3 mm and 10 mm such that liquid can easily pass through and that the strength of the core plate 21 is substantially not reduced. Preferably, the opening width Wb of each of the discharge parts 215*a*-215*c* is desirably set as 5 mm.

As shown in FIG. 4 and FIG. 5, the tube junction portion 211 of the core plate 21 has plural tube insertion holes 211*a* arranged with a predetermined interval in the tube stacking direction YD, and the tube is joined to the core plate 21 by brazing in the state where the end of each tube 11 is inserted.

The core plate 21 of this embodiment is defined by the connection between the tube junction portion 211 and the inner wall part 212*c* of the housing groove portion 212. Thereby, the core plate 21 has a stepped shape at the position between the tube junction portion 211 and the bottom wall part 212*a* of the housing groove portion 212.

Then, the tank body 22 is explained. The tank body 22 of this embodiment is formed by resin such as polyamide strengthened with glass fiber. The tank body 22 of this embodiment has the flange part 221 at the tip part close to the core plate 21, and the flange part 221 has a thickness larger than the other parts.

The flange part 221 has a size able to be housed by the housing groove portion 212. The flange part 221 has a bottom surface 221*a* opposing the bottom wall part 212*a* of the housing groove portion 212, and a side surface 221*c* opposing the outer wall part 212*b* of the housing groove portion 212.

The bottom surface 221*a* of the flange part 221 of this embodiment has a projection part 221*b* projected toward the bottom wall part 212*a* of the housing groove portion 212. The projection part 221*b* is formed to stabilize, for example, the position of the seal component 23 to be mentioned later when the seal component 23 is forced onto the bottom wall part 212*a* of the housing groove portion 212.

The flange part 221 is housed in the housing groove portion 212 in the state where the bottom surface 221*a* of the flange part 221 and the bottom wall part 212*a* of the housing groove portion 212 are separated from each other, and where the side surface 221*c* of the flange part 221 and the outer wall part 212*b* of the housing groove portion 212 are separated from each other. Thereby, the housing space 21*a* housing the seal component 23 is formed between the flange part 221 and the inner periphery surface of the housing groove portion 212.

The clearance C formed between the flange part 221 of the tank body 22 and the outer wall part 212*b* is communicated with outside through each of the discharge parts 215*a*-215*c*, in the housing space 21*a* of this embodiment.

Then, the seal component 23 is explained. The seal component 23 is a component which suppresses the leak of the cooling water from the tank interior space 20*b*. The seal component 23 of this embodiment is made of rubber which is elastically deformable. The seal component 23 may be made of, for example, silicon rubber or EPDM (ethylene propylene diene rubber).

The seal component 23 of this embodiment is annularly formed to be housed in the housing groove portion 212, and is housed in the housing space 21*a* formed between the flange part 221 and the inner periphery surface of the housing groove portion 212. The seal component 23 of this embodiment is supported between the bottom wall part 212*a* of the housing groove portion 212 and the bottom surface 221*a* of the flange part 221 in the elastically deformed state.

Next, the production method of the radiator 1 is explained. At a first process, components for producing the radiator 1 are prepared (preparation process). The preparation process includes a process of fabricating the core plate 21 having the tube junction portion 211, the housing groove portion 212, the projection piece 213, the cutout grooves 214*a*, 214*b*, and the discharge parts 215*a*-215*c*.

Then, the core part 10 is preassembled by stacking the tubes 11, the fins 12, and the side plates 40, which were prepared in the preparation process, in the tube stacking direction YD, on a working table (in a preassembling process).

Then, after attaching the core plate 21, in which the tube insertion hole 211*a* is formed, to the core part 10, the assembled state is held by a jig such as a wire. Furthermore, in this process, the preassembled body in which the core plate 21 is attached to the core part 10 is placed in a heated furnace to join the core plate 21 and the core part 10 by brazing (in a brazing junction process).

After the brazing junction process is ended, the flange part 221 of the tank body 22 and the seal component 23 are received in the housing groove portion 212 of the core plate 21. Specifically, in this process, the flange part 221 is received in the housing groove portion 212 in the state where the seal component 23 is arranged on the bottom wall part 212*a* of the housing groove portion 212.

Then, each projection piece 213 of the core plate 21 is plastically deformed by press processing in the state where the flange part 221 and the seal component 23 are received in the housing groove portion 212, such that the tank body 22 is fixed to the core plate 21.

The manufacture of the radiator 1 is completed after an inspection process such as leak inspection and dimensional check. In the leak inspection, it is checked whether poor brazing or poor connection is generated in the junction part between the components of the radiator 1.

The radiator 1 of this embodiment generates the following effects due to the above-mentioned configuration. The radiator 1 of this embodiment has the seal component 23 that is fittingly supported between the bottom wall part 212*a* of the housing groove portion 212 of the core plate 21 and the bottom surface 221*a* of the flange part 221 of the tank body 22 in the elastically deformed state. Thereby, the tank interior space 20*b* of each of the header tanks 20 and 30 can be sealed.

Figure 7:
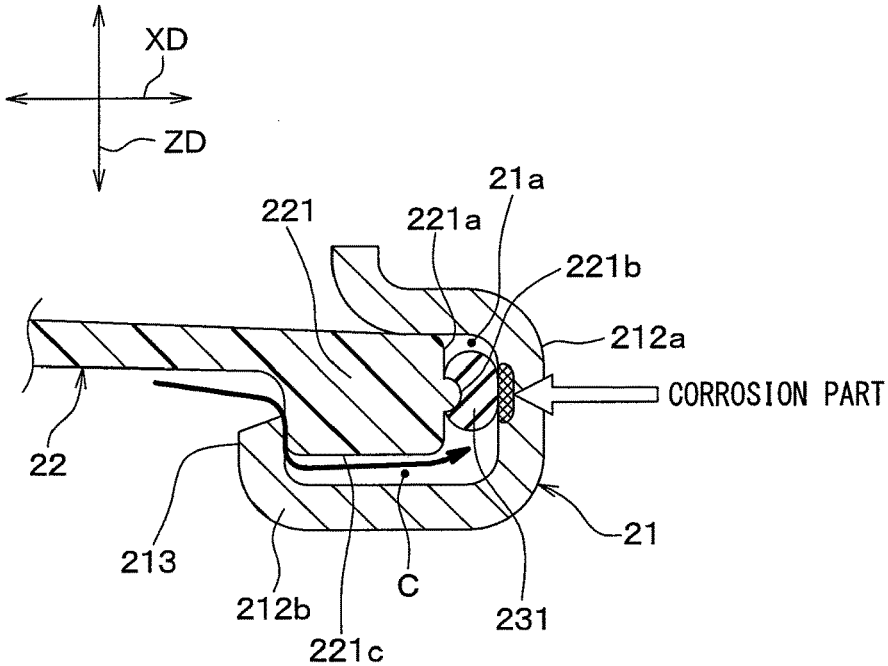
FIG. 7 is a sectional view explaining a flow of liquid outside of a header tank of a radiator of a comparative example.

FIG. 7 is a sectional view illustrating a configuration in which the seal component 23 is arranged between the bottom wall part 212*a* of the housing groove portion 212 and the side surface 221*c* of the flange part 221 (hereafter called as a comparative example).

In the comparative example, the leak of the cooling water from the header tank 20, 30 is suppressed by the seal component 23 that seals the tank interior space 20*b* of each header tank 20, 30.

However, in the comparative example, as shown by an arrow of FIG. 7, liquid which has corrosiveness (for example, sea water and acid rain) reaches the bottom wall part 212*a* of the housing groove portion 212 from outside through the clearance C between the outer wall part 212*b* of the housing groove portion 212 and the side surface 221*c* of the flange part 221.

If the corrosive liquid stagnates on the bottom wall part 212*a* of the housing groove portion 212, a part of the bottom wall part 212*a* in contact with the seal component 23 will corrode. This corrosion causes a minute clearance between the bottom wall part 212*a* and the seal component 23, such that cooling water may slightly leak from the header tank 20, 30.

In contrast, the radiator 1 of this embodiment has the plural discharge parts 215*a*-215*c* at the lower part of the outer wall part 212*b* of the core plate 21 in the tube stacking direction YD.

Figure 8:
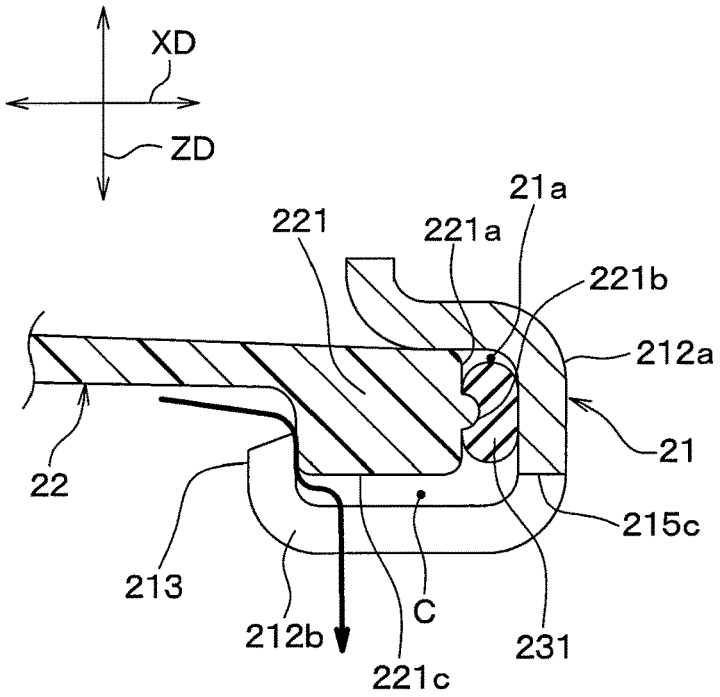
FIG. 8 is a sectional view explaining a flow of liquid outside of the header tank of the radiator of the embodiment.

Thereby, even if the corrosive liquid flows in the clearance C between the tank body 22 and the core plate 21, as shown in FIG. 8, the liquid can be discharged outside through each of the discharge parts 215*a*-215*c* defined in the outer wall part 212*b*. As a result, the corrosive liquid coming from outside of the radiator can be restricted from stagnating on the bottom wall part 212*a* of the housing groove portion 212 of the core plate 21.

Therefore, according to the radiator 1 of this embodiment, the corrosion of the core plate 21 caused by the corrosive liquid which exists outside is suppressed, and it becomes possible to control the leak of the fluid from the header tank 20, 30.

Moreover, the core plate 21 of this embodiment has the four sides Sp1-Sp4 and the four corner parts Cp1-Cp2, when seen from the tube longitudinal direction XD. In the radiator 1 with the core plate 21, due to the action of gravity, the liquid coming from outside to the gap between the tank body 22 and the core plate 21 easily gathers at the side Sp4 or the corner parts Cp3 and Cp4 located on the lower side in the tube stacking direction YD.

For this reason, in this embodiment, the first to third discharge parts 215*a*-215*c* are formed at the positions corresponding to the side Sp4 and the corner parts Cp3 and Cp4 in the outer wall part 212*b*. Accordingly, it becomes possible to efficiently drain the liquid coming from outside to the gap between the tank body 22 and the core plate 21.

According to the present embodiment, the opening area of the first to third discharge part 215*a*-215*c* is larger than the opening area of each of the cutout grooves 214*a* and 214*b*. The drain efficiency of liquid which invaded between the tank body 22 and the core plate 21 can be raised.

Moreover, in this embodiment, the clearance C is formed between the flange part 221 of the tank body 22 and the outer wall part 212*b*, and the clearance C is made to communicate with outside through the first to third discharge parts 215*a*-215*c*. Therefore, the liquid which invaded from the upper side of the outer wall part 212*b* can be discharged to outside through each of the discharge parts 215*a*-215*c* by making the liquid to flow downward through the clearance between the flange part 221 and the outer wall part 212*b*.

The corrosive liquid (for example, sea water and acid rain) easily flows in, with the outside air, the radiator mounted in a vehicle to exchange heat between the fluid flowing through the tubes 11 of the core part 10 and the outside air to cool the fluid. For this reason, the structure of suppressing the invasion of corrosive liquid toward the bottom wall part 212*a* of the housing groove portion 212 in the radiator 1 like this embodiment is suitable for the radiator mounted in a vehicle.

(Modifications of Embodiment)

The first to third discharge parts 215*a*-215*c* are provided at the positions corresponding to the side Sp4 and the corner parts Cp3 and Cp4 in the outer wall part 212*b* in the above-mentioned embodiment, and may be modified as follows without being limited to the embodiment.

(First Modification)

Figure 9:
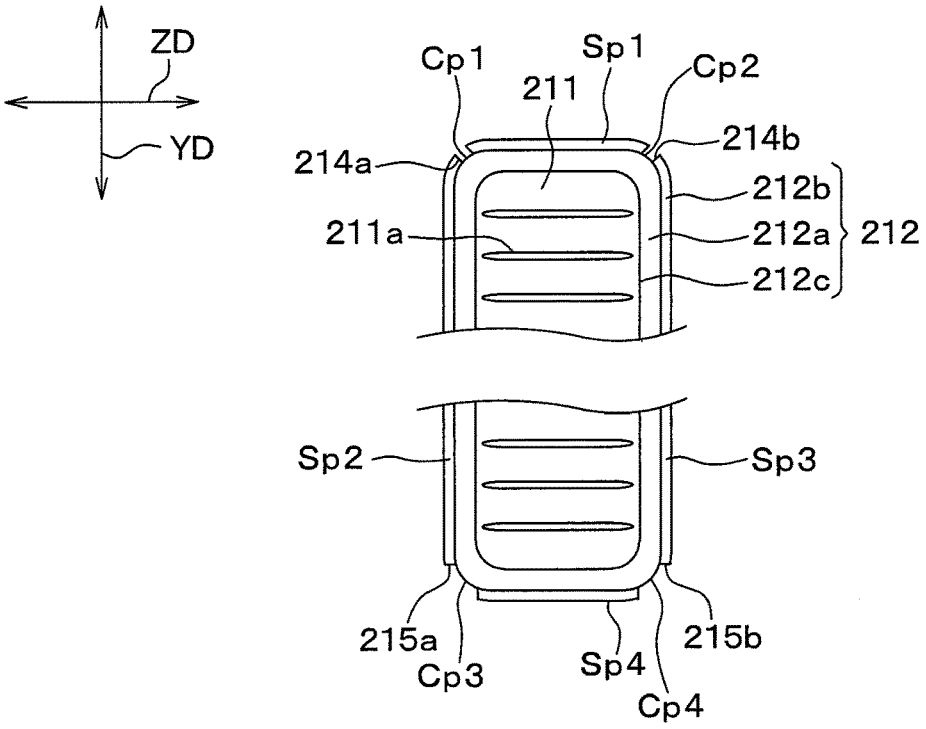
FIG. 9 is a sectional view illustrating a first modification of the core plate of the radiator of the embodiment.

FIG. 9 is a drawing corresponding to FIG. 4 in the above-mentioned embodiment. That is, FIG. 9 is a bottom view of a core plate 21 alone, of a radiator 1 according to a first modification.

As shown in FIG. 9, in the first modification, the first and second discharge parts 215*a* and 215*b* are provided at the positions corresponding to the corner parts Cp3 and Cp4 in the outer wall part 212*b*. In addition, in the first modification, the discharge part is not defined at the position corresponding to the side Sp4 in the outer wall part 212*b*.

The other configuration is the same as that of the above-mentioned embodiment. According to the radiator 1 equipped with the core plate 21 of the first modification, if the liquid which has corrosiveness invades between the tank body 22 and the core plate 21, the liquid can be discharged outside through each of the discharge parts 215*a* and 215*b* defined in the outer wall part 212*b*.

(Second Modification)

Figure 10:
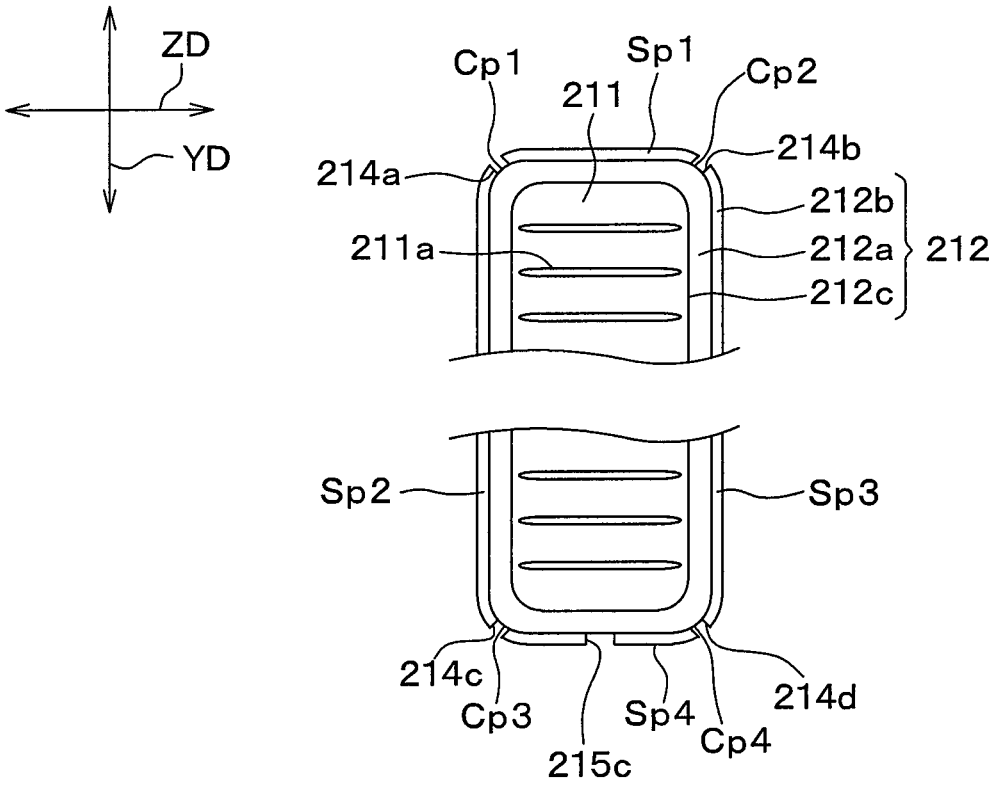
FIG. 10 is a sectional view illustrating a second modification of the core plate of the radiator of the embodiment.

FIG. 10 is a drawing corresponding to FIG. 4 in the above-mentioned embodiment. That is, FIG. 10 is a bottom view of a core plate 21 alone, of a radiator 1 according to a second modification.

As shown in FIG. 10, in the second modification, the third discharge part 215*c* is provided at the position corresponding to the side Sp4 in the outer wall part 212*b*. In the second modification, cutout grooves 214*c* and 214*d* are defined at the positions corresponding to the corner parts Cp3 and Cp4 in the outer wall part 212*b*. Each of the cutout grooves 214*c* and 214*d* is configured like the cutout groove 214*a*, 214*b* explained in the above-mentioned embodiment.

The other configuration is the same as that of the above-mentioned embodiment. According to the radiator 1 equipped with the core plate 21 of the second modification, if the liquid which has corrosiveness invades between the tank body 22 and the core plate 21, the liquid can be discharged outside through the third discharge part 215*c* defined in the outer wall part 212*b*.

Other Embodiment

The present disclosure is not limited to the above-described embodiment, and can be changed suitably. The heat exchanger of the present disclosure can be variously modified, for example, as follows.

The discharge parts 215*a*-215*c* are desirably formed at the positions corresponding to the side Sp4 and the corner parts Cp3 and Cp4 in the outer wall part 212*b* like the above-mentioned embodiment, but are not limited to this, while the discharge part is located on the lower side of the outer wall part 212*b* in the tube stacking direction YD. The discharge part may be defined at a position corresponding to, for example, a lower part of the sides Sp2 and Sp3 in the outer wall part 212*b*.

The opening depth Hb and the opening width Wb of each of the discharge parts 215*a*-215*c* are respectively larger than the opening depth Ha and the opening width Wa of each of the cutout grooves 214*a* and 214*b* in the above-mentioned embodiment, but are not limited to this. While the opening area of each of the discharge parts 215*a*-215*c* is larger than the opening area of each of the cutout grooves 214*a* and 214*b*, one of the opening depth and the opening width may be approximately the same between the cutout groove 214*a*, 214*b* and the discharge part 215*a*-215*c*.

The discharge part 215*a*-215*c* has the open slit shape in the above-mentioned embodiment, but is not limited to this. Each of the discharge parts 215*a*-215*c* may be defined by a through hole.

It is desirable to provide the pair of cutout grooves 214*a* and 214*b* at the positions corresponding to the pair of corner parts Cp1 and CP2 at the upper side in the core plate 21 like the above-mentioned embodiment, but is not limited to this. The pair of cutout grooves 214*a* and 214*b* may not be provided.

The heat exchanger of the present disclosure is applied to the radiator 1 for a vehicle in each of the embodiments, but is not limited to this. The heat exchanger of the present disclosure may be applied to an outdoor heat exchanger of a refrigerating cycle for a vehicle, or a radiator in a fixed freezer for other than a vehicle.

In the respective embodiments above, it goes without saying that elements forming the embodiments are not necessarily essential unless specified as being essential or deemed as being apparently essential in principle.

In a case where a reference is made to the components of the respective embodiments as to numerical values, such as the number, values, amounts, and ranges, the components are not limited to the numerical values unless specified as being essential or deemed as being apparently essential in principle.

Also, in a case where a reference is made to the components of the respective embodiments above as to shapes and positional relations, the components are not limited to the shapes and the positional relations unless explicitly specified or limited to particular shapes and positional relations in principle.

What is claimed is:

1. A heat exchanger comprising:

a core part having a plurality of tubes stacked up and down, a fluid flowing through the plurality of tubes; and a header tank arranged at ends of the tubes in a longitudinal direction of the tubes, the header tank extending in a stacking direction of the tubes and communicating with the plurality of tubes, wherein the header tank has a core plate to which the plurality of tubes is joined in a state where the ends of the tubes in the longitudinal direction are inserted in a plurality of tube insertion holes, a tank body fixed to the core plate to form a tank interior space together with the core plate to communicate with the plurality of tubes, a seal component interposed between the tank body and the core plate to suppress a leak of the fluid from the tank interior space, the core plate has a tube junction portion having the plurality of tube insertion holes, and a housing groove portion having an annular shape surrounding an outer side of the tube junction portion and housing a tip part of the tank body and the seal component, the seal component is housed in a housing space formed by an inner periphery surface of the housing groove portion and an opposing surface of the tip part of the tank body opposing the core plate, the housing groove portion has a bottom wall part which supports the seal component together with the tip part of the tank body, and an outer wall part located at an outer periphery side of the bottom wall part, the outer wall part has at least one discharge part which discharges liquid from a clearance between a side surface of the tank body opposing the outer wall part and a lower side of the outer wall part in the stacking direction of the tubes, the core plate is shaped to have four sides and four corner parts when seen from the longitudinal direction of the tubes, the outer wall part has a cutout groove opened at an upper side in the stacking direction of the tubes, the cutout groove is defined at a position, among the four corner parts of the outer wall part, corresponding to a corner part located on an upper side in the stacking direction of the tubes, the discharge part is defined at a position, among the four sides and the four corner parts of the outer wall part, corresponding to a side or a corner part located on a lower side in the stacking direction of the tubes, and the discharge part has an open area that is larger than an open area of the cutout groove.

2. The heat exchanger according to claim 1, wherein the clearance defined between the tip part of the tank body and the outer wall part in the housing space communicates with outside through the discharge part.

3. The heat exchanger according to claim 1, configured as a radiator disposed in a vehicle, wherein the core part is configured as a heat emitting part which cools the fluid flowing inside the plurality of tubes by exchanging heat with air outside of the vehicle.

* * * * *